US010151200B2

(12) United States Patent
MacIntyre et al.

(10) Patent No.: US 10,151,200 B2
(45) Date of Patent: Dec. 11, 2018

(54) ORE REMOVAL PRODUCTION LINE, TWIN RAMPS AND GROUND SUPPORT INSTALLATION METHOD

(71) Applicant: VALE S.A., Rio de Janeiro (BR)

(72) Inventors: Daniel MacIntyre, Sudbury (CA); Peter Golde, Rio de Janeiro (BR); Michael Van Der Hooft, Greater Sudbury (CA)

(73) Assignee: VALE S.A., Rio de Janeiro (BR)

( * ) Notice: Subject to any disclaimer, the term of this patent is extended or adjusted under 35 U.S.C. 154(b) by 623 days.

(21) Appl. No.: 14/280,357

(22) Filed: May 16, 2014

(65) Prior Publication Data

US 2014/0339880 A1 Nov. 20, 2014

Related U.S. Application Data

(60) Provisional application No. 61/824,749, filed on May 17, 2013, provisional application No. 61/824,838, filed on May 17, 2013.

(51) Int. Cl.
*E21C 41/16* (2006.01)
*E21C 41/22* (2006.01)
(Continued)

(52) U.S. Cl.
CPC ..... *E21C 35/20* (2013.01); *E21C 41/16* (2013.01); *E21C 41/22* (2013.01); *E21F 13/02* (2013.01); *E21F 13/06* (2013.01)

(58) Field of Classification Search
CPC ..... E21C 41/16; E21C 41/14; E21C 41/22; E21D 9/14; E21D 11/14; E21D 19/00;
(Continued)

(56) References Cited

U.S. PATENT DOCUMENTS 2,874,945 A * 2/1959 McWhorter ..... E21C 41/18 299/11
3,752,334 A * 8/1973 Robinson, Jr. ..... B65G 35/00 104/168

(Continued)

OTHER PUBLICATIONS

Underground Mine Development, Dec. 1, 2011, International Mining.*

(Continued)

*Primary Examiner* — David J Bagnell
*Assistant Examiner* — Michael A Goodwin
(74) *Attorney, Agent, or Firm* — Arent Fox LLP

(57) ABSTRACT

The present invention refers to a set of methods and procedures that may be combined in order to greatly increase the speed of development of an access ramp in a underground hard-rock mine. More particularly, the present invention was designed to target all the bottle-necks comprised by the access operation of a hard-rock mine that employs a RAILVEYOR machine. The invention also comprises of an ore production line which consists in the sequential arrangement of a series of mining equipment between the work face and the entrance of a hard-rock mine. The invention also comprises a Hard Rock Mining Access Plan for a hard-rock mine which encompasses two parallel ramps interconnected by cross-cut passageways. Further, invention also comprises a Ground Support Installation method configured to shorten the time required for the installation of ground support inside of a hard-rock mine.

6 Claims, 6 Drawing Sheets

(51) Int. Cl.
*E21F 13/02* (2006.01)
*E21F 13/06* (2006.01)
*E21C 35/20* (2006.01)

(58) Field of Classification Search
CPC . E21F 13/00; E21F 13/02; E21F 13/04; E21F 13/06; E21F 13/063; E21F 13/002
USPC ..... 299/19
See application file for complete search history.

(56) References Cited

U.S. PATENT DOCUMENTS 4,440,448 A * 4/1984 Hoberstorfer ..... E21C 41/16 299/11
4,957,405 A * 9/1990 Roberts ..... B65G 41/02 198/594
8,140,202 B2 3/2012 Dibble et al.
8,955,667 B1 2/2015 Dibble
9,061,692 B1 6/2015 Dibble et al.
9,409,714 B2 8/2016 Dibble
2003/0226470 A1 12/2003 Dibble et al.
2005/0073189 A1* 4/2005 O'Quinn ..... E21D 19/00 299/11
2006/0162608 A1 7/2006 Dibble
2008/0154451 A1 6/2008 Dibble et al.
2010/0114404 A1* 5/2010 Donnelly ..... B61D 3/16 701/2
2011/0044770 A1* 2/2011 Potvin ..... E21D 19/00 405/302.7
2013/0119745 A1* 5/2013 Zimmerman ..... E21F 13/00 299/18
2014/0262219 A1* 9/2014 Beddoes ..... E21B 43/00 166/244.1

OTHER PUBLICATIONS

Ruprecht, Mine Development—Access to Deposit, 2012, The Southern African Institute of Mining and Metallurgy, pp. 101-105.*
Wallis, Chilean Mine Invites Access to Project Proposals, Nov. 2009, Tunneltalk.com (2 pages).*

* cited by examiner

ORE REMOVAL PRODUCTION LINE, TWIN RAMPS AND GROUND SUPPORT INSTALLATION METHOD

CROSS-REFERENCE TO RELATED APPLICATIONS

This application, claims priority to U.S. Provisional Application Nos. 61/824,749 and 61/824,838, both filed May 17, 2013, the disclosures of each of these prior applications being hereby incorporated in their entirety by reference.

The present invention refers to a set of methods and procedures that may be combined in order to greatly increase the speed of development of an access ramp in a underground hard-rock mine.

BACKGROUND OF THE INVENTION

In a hard-rock mining operation, compressing the time required to bring an ore body into production allows for a faster generation of value, for an increase in the operating margins and to ensure that a project is completed on time and inside the boundaries of a predefined budget.

In this context, a new technology, named "RAIL-VEYOR"provides a new platform to revolutionize the way material is removed of an underground mine. The RAIL-VEYOR technology presents the opportunity to challenge the current historic low rate of development of underground mines of 35 meters per week.

The RAIL-VEYOR is a new type of particulate transportation machine, designed for general purposes, such as transporting minerals, cement and wood chips. The RAIL-VEYOR comprises a pair of rails, and a set of cars interconnected by clevis joints. Each one of these cars communicates with the adjacent car, revealing no boundaries between them. The element comprised by the cars, that allow this mutual connection, is an urethane flap, designed to cover the gap among two adjacent cars, providing a continuous surface at the bottom of the cars.

The RAIL-VEYOR cars do not comprehend any internal drive. They are moved along the rails by means of external drive stations which comprise rubber tires associated with electric motors. The external surface of those rubber tires are positioned in parallel with the side surfaces of the cars, and when those tires spin, they propel the Rail-Veyor forward, in the similar way that a roller coaster car is propelled over its track.

Another particular feature of this transportation method is the inclusion of an upper guiding plate inside of the rails, which prevents the cars from de-railing when they come across a vertical loop ahead in their path. This vertical loop defined by the RAIL-VEYOR's rails allows the cars to be turned upside-down, above a storage site, for the sake of material discharging.

Although the RAIL-VEYOR can be considered "breakthrough technology" which opens a new line of opportunity to speed up the ore extraction process, when the whole ore removal operation in a hard rock mining is taken into consideration, taking into account all the auxiliary machines and methods that operate in conjunction with the RAIL-VEYOR, this technology alone is not capable of diminishing the time for the ore removal execution.

Conventional methods of development do not use the RAIL-VEYOR technology in hard rock mining operations, and they involve other auxiliary equipment, procedures and methods that advance at slower rates, but have been utilized extensively in traditional development processes. For example, conventional methods of development have more extensive use of the LHD (load haul dump) equipment and haulage trucks. During the ore removal process, the LHD unit is empty (carrying no payload) 50% of the time. This equipment is very dependent on a human operator's skill and requires a great level of attention by the personnel involved in its manipulation. Further, it is noteworthy that the increased productivity levels demanded by the mining industry require that an operator performs the load-haul-dump cycle up to 250 times each working shift. This level of repetitive work cannot be safely sustained for the whole period as an operator will quickly tire after only four hours, thereby significantly increasing the risk of making costly mistakes that can result in equipped damage or even injury.

Other factors that contribute to slow down the ore removal operation in conventional operations, aside from the LHD units, are:

A large cross-section area of the ramp (currently in the range of at least 5 m high and 5 m wide) which require more holes to be drilled on the work face of the ramps for the placement of the explosive charges;

Interference of machines and personal that get across each other when traveling in opposite directions inside of the ramp; and The slow installation of ground support due to a higher ground support surface area and the old-fashioned methods currently employed in this operation;

Objectives

It is proposed that the following objectives would be desirable in appropriate development applications:

- To speed up the process of development of an access to the ore body inside a hard rock mine.
- To remove the bottlenecks comprised by the conventional ramp development methods.
- To provide more safety for the hard rock mining process.

BRIEF DESCRIPTION OF THE INVENTION

The invention describes an ore production line for a hard rock mine that comprises the following equipment linearly arranged between the work face of the mine and the outdoor environment:

- at least one continuous loader machine placed nearby the work face;
- followed by at least one Haulage Equipment;
- followed by an Ore Sizer Equipment;
- followed by a Storage Buffer;
- followed by a RAIL-VEYOR machine.

The invention also describes a Hard Rock Mining Access Plan for a hard-rock mine that includes two parallel ramps interconnected by a series of cross-cuts passageways, both ramps and the cross-cuts passageways having between 2.9 and 3.3 meters high and between 3.5 and 3.9 meters wide.

Further, the invention also describes a Ground Support Installation method for a hard rock mining operation, which comprises two steps:

- the first step consists of installing a minimum support required to ensure the safety of the development miners and the stability of the opening for the development phase;
- the second step consists of installing a permanent support required to ensure the safety of the workers and the opening stability throughout the mine's life.

DETAILED DESCRIPTION OF THE INVENTION

The present invention describes a combination of methods and equipments whose combined operation provides a faster material removal process and a faster ramp access development rate in a hard rock mining operation.

The invention achieves its objectives by targeting each one of the former bottlenecks encompassed by the conventional ramp development operation.

In a preferred embodiment, the present invention comprises two parallel ramps, also called "twin ramps", each one of them revealing the same cross-sectional area of: 3 meters high and 3.6 meters wide. Although 3 m H and 3.6 m W are the preferred dimensions comprised by the twin ramps, it is worth to note that any dimensions comprised between 2.9 and 3.3 for the height and anything between 3.5 and 3.9 for the width of the ramps is under the scope of the present invention.

The first ramp, called RV ramp 1 (or RAIL-VEYOR Ramp) is used exclusively as the passageway of the RAIL-VEYOR.

The second ramp, called RT ramp 2 (or Rubber-Tired Ramp) is designed to encompass all other wheeled equipment that may come inside of the mine.

Figure 3:
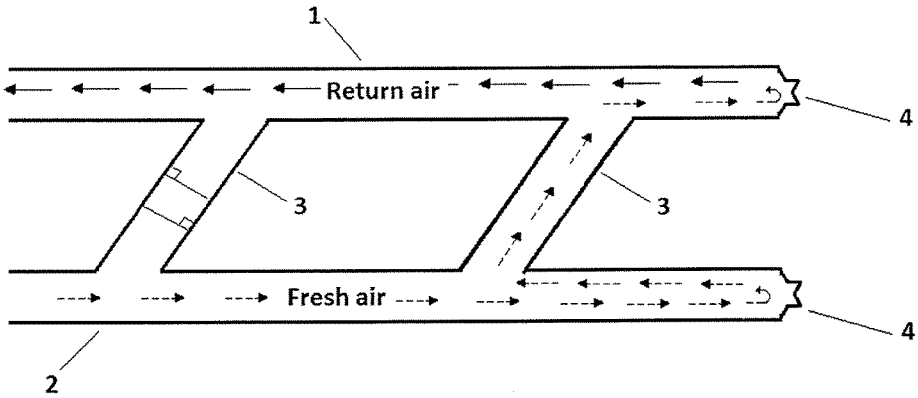
FIG. 3—Depicts a top view representation of the twin ramps of the present invention connected by cross-cuts passageways.

The twin ramps follow parallel paths and they are interconnected by a series of crosscuts passageways (3) adjoining the two ramps (1 & 2). These passageways have the same dimensions of the RV ramp and the RT ramp. These ramps can be seen in FIG. 3.

The dimensions 3 m high and 3.6 m wide were chosen, based on the sizes of the equipment employed by the present invention and the flow rate of fresh air required at the work face of the ramps. Although lower dimensions could be applied to the RV ramp, the RV ramp dimensions mimic the RT ramp dimensions mainly due to the following facts: by doing so, both ramps (the RV and the RT ramp) have similar advance rates; and, by doing so, both of them may share the same mining equipment.

Many advantages are proposed by the present invention stem from the two parallel ramps having smaller cross sectional areas.

Firstly, it should be noted that, two smaller cross sectional areas are much better suited for a faster access plan than a single large cross sectional area. The reason for this is the fact that the two parallel ramps can be drilled at the same time. Further, it is obvious that a smaller cross sectional ramp may be opened more quickly when compared to a large cross sectional ramp. This is because a smaller cross sectional work face require less explosive holes to be drilled at the wall, less explosive charges to be placed inside those holes, and less material to be scooped out of the stope after the detonations.

Additionally, the combination of two parallel ramps, instead of only one ramp, minimizes the problem of interference/collision of vehicles cruising towards the same point while driving in opposite directions inside of the mine.

The twin ramps also provide a cyclical path for the circulation of fresh air inside of the mine. Notice through FIG. 3 that the RT ramp defines an access route to fresh air, while the RV ramp defines an exit route to the return air. This design provides a constant flow of fresh air to the workers at the face, providing a better work environment for these men.

It is suggested that the inclination of the ramps be set at approximately 15%. A steeper ramp could be achieved if the power of the drive stations and the drive capacity of the other machines were to be increased. It is suggested that anything between 14% and 16% shall be considered reasonable as the steepness rate for the twin ramps. This also takes into consideration ideal mining conditions for jumbo drills, etc.

Whenever the integrity of the ground of a hard rock body is potentially compromised by mining activity, the inner surfaces of the ramp walls must be covered with some sort of structural layer which is designed to prevent smaller rocks from accidentally falling inside of the ramp, exposing the workers and the equipment traveling inside of the drift.

This structural layer is called "ground support" by the mining experts. The ground support installation in conventional methods represents the longest process within the development cycle. On average the ground support installation in the conventional technique accounts for 40% of the total cycle time.

One opportunity to speed up the ground support installation is to stage the ground support operation in two distinct steps. The first step consists of installing a minimum support required to ensure the safety of the miners and the stability of the opening for the development phase. The second step consists of installing a permanent support required to ensure the safety of the workers and the opening stability throughout the mine's life.

The first step consists in the excavation of spans ranging from 3 to 3.6 m followed by the installation of a wire mesh of #9 or #6 gauge or the application of a layer of fiber reinforced shotcrete with a nominal thickness of 2 to 3 inches throughout the entire surface of the walls (if the local Ground Control Procedures permit).

The second step consists in the installation of 1.5 m long grouted rebars on 1.2 m×1.8 m staggered pattern with a 4 m×2.75 m welded wire mesh.

Alternatively, there might be no second step if the fiber reinforced shotcret is applied and its given sufficient curing time so that it reaches up to 6 or 7 MPa of strength. This level of strength may be achieved when the shotcrete is cured for over 8 hours without any external interference.

Figure 1:
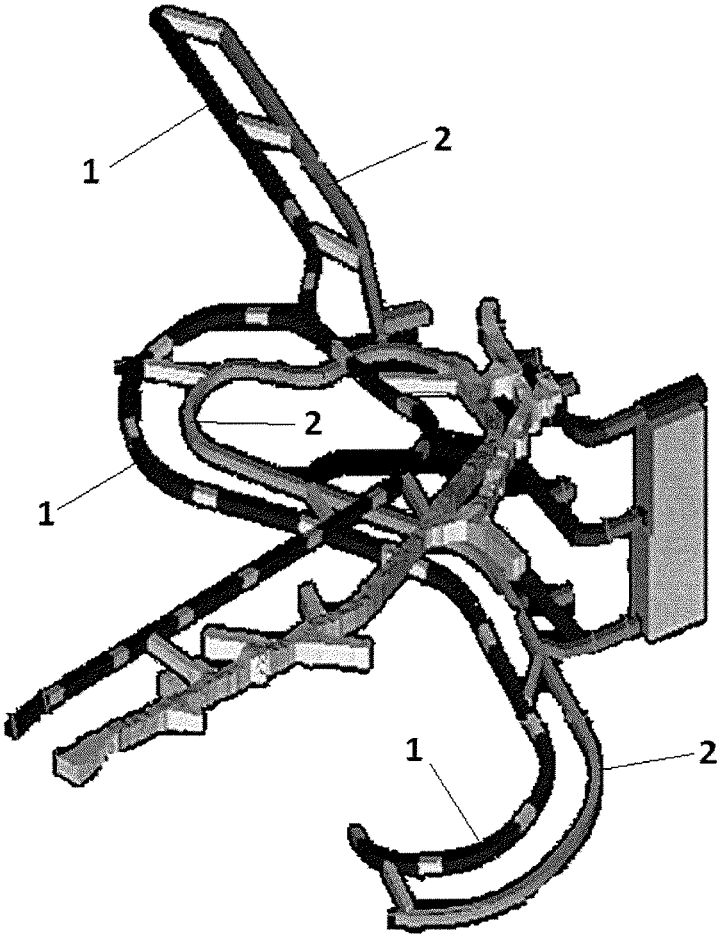
FIG. 1—Top perspective view of a computerized representation of the "twin ramps" comprised by the present invention.
Figure 2:
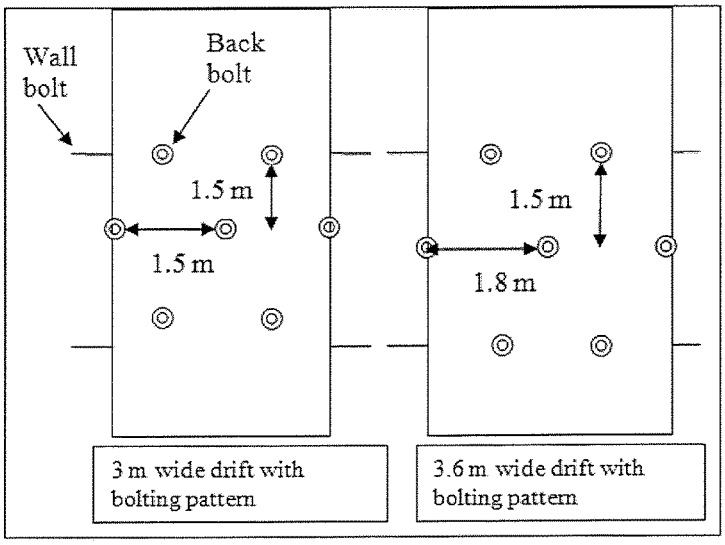
FIG. 2—Depicts the bolt pattern applied to the spans in the ground support operation in a preferred embodiment of the invention.

The bolt pattern applied to the spans is preferably 3 bolts (1 per shoulder and one in the drift centre) by 2 bolts staggered (see FIG. 2).

Additionally, 8 bolts shall be installed for each welded wire screen applied for the present drift dimensions.

Another major bottleneck in the conventional ore removal process is the slow rate of transportation of material from the work face (4 in FIG. 3) to the loading point of the RAIL-VEYOR.

As stated on the description of conventional method earlier in this document, the LHD units are currently used by the conventional methods to transport rocks from the drawbell to the RAIL-VEYOR. These machines are empty 50% of the time they move inside of the ramp. Nonetheless, this type of equipment is much more prone to be involved in accidents than other mining machines, since they are very human dependent, and the workers in charge of their manipulation are always under pressure due to long hour shifts and the extenuating repetitive work required by their operation.

These LHD units, therefore, are the Achilles' heel of the mucking operation in hard-rock mining that use the RAIL-VEYOR.

The present invention proposes the replacement of the LHD units by an ore production line, which comprises the following set of equipment, disposed in following arrangement between the drawbell and the loading point of the RAIL-VEYOR: i. At Least one Continuous Loader; ii. At Least one Haulage equipment; iii. One Ore Sizer; and iv. One Storage Buffer.

The four types of equipment listed above are described in details bellow:

Continuous Loader

Figure 5:
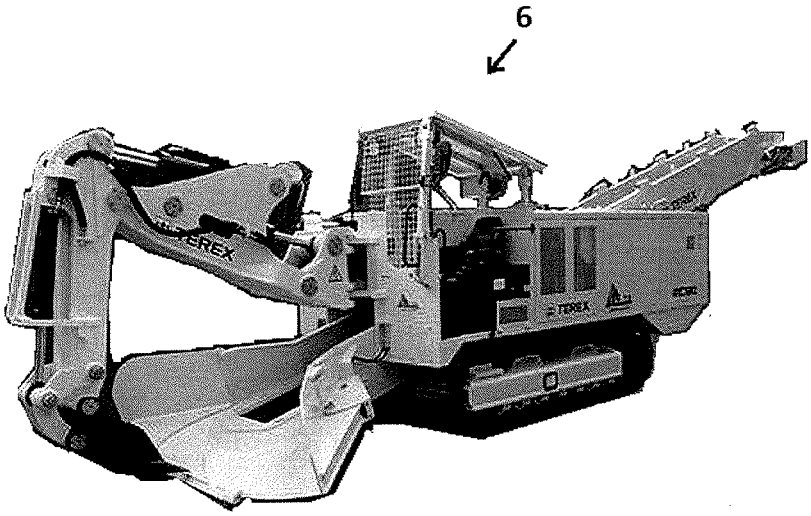
FIG. 5—Depicts a Continuous Loader equipment employed by the ore production line of the proposed invention.
Figure 6:
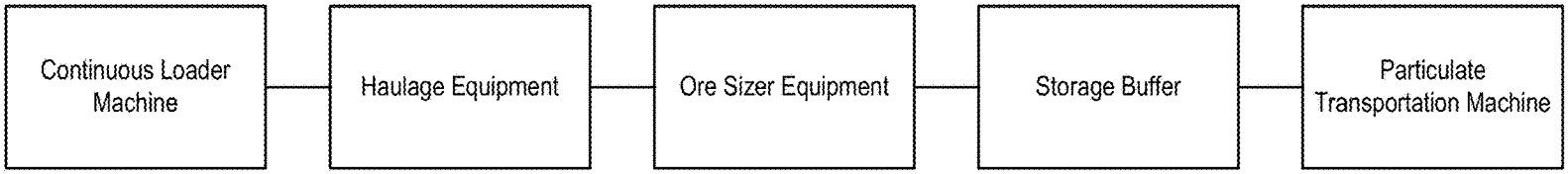
FIG. 6—Depicts an ore production line and its arrangement.
Figure 7:
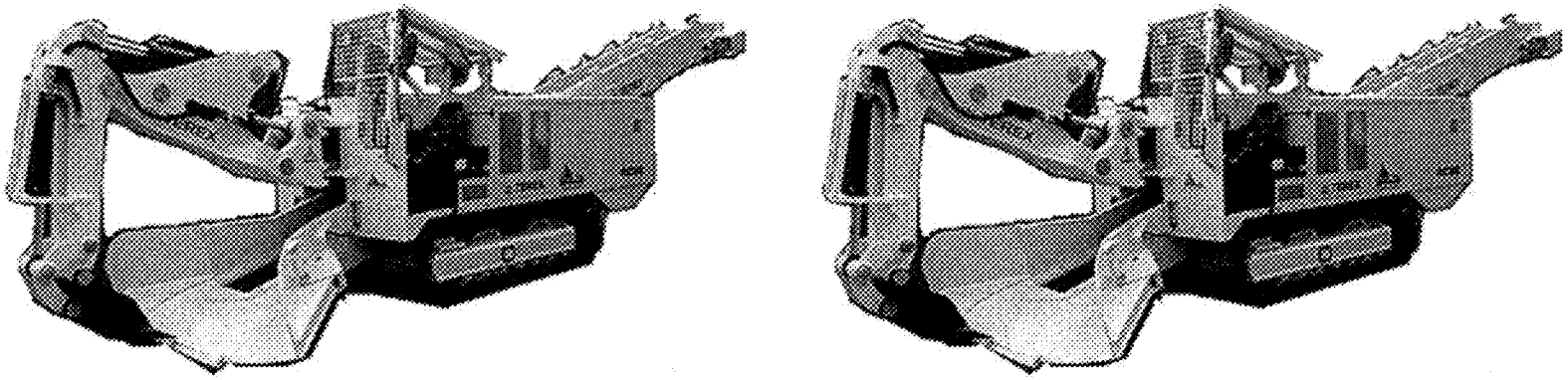
FIG. 7—Depicts two continuous loader machines employed by the ore production line.
Figure 8:
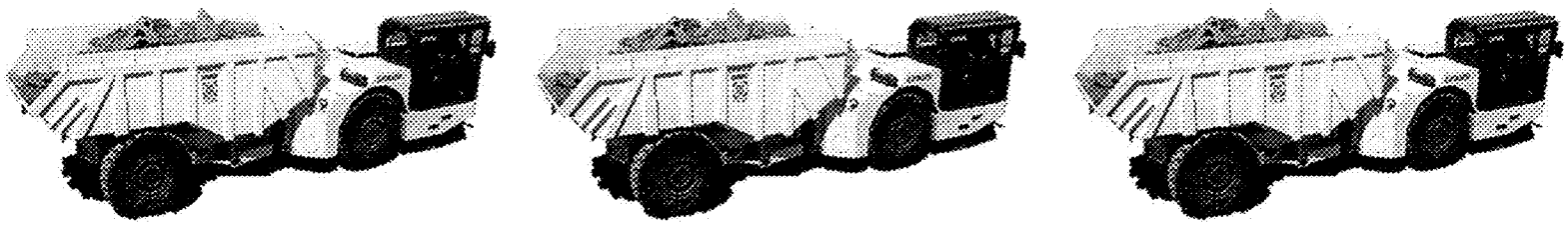
FIG. 8—Depicts three haulage trucks employed by the ore production line.

A continuous loader (see #6 in FIG. 5) is a mobile equipment that uses a gathering arm equipped with a bucket to continuously pull broken ore from the drawpoint towards an internal chain flight conveyor which has the purpose of transporting the collected material to the second type of equipment comprised by the aforementioned production line.

In a preferred embodiment, the present invention uses the ITC SCHAEFF LOADER MODEL ITC 120 F4. This model will operate in a 3 m x 3.6 m drift, without slashes. It can also travel in and out of the cross-cut, underneath the twin ducts required for the push auxiliary ventilation system. Operating on a 15% down ramp, handling material with a density of 2800 kg/m3, the loader has a mucking capacity of 1.22 m3/min. The loader will remain at the face during the mucking operation and will be feeding the haulage equipment.

Two of these loaders are required for achieving the best operational results in the hard rock mining access development.

In parallel to the use of the continuous loader, scoops (such as the LHD units) may be used only at the opening operation of the ramps and to serve minor miscellaneous functions during the rock-mining development process.

Haulage Equipment

Figure 4:
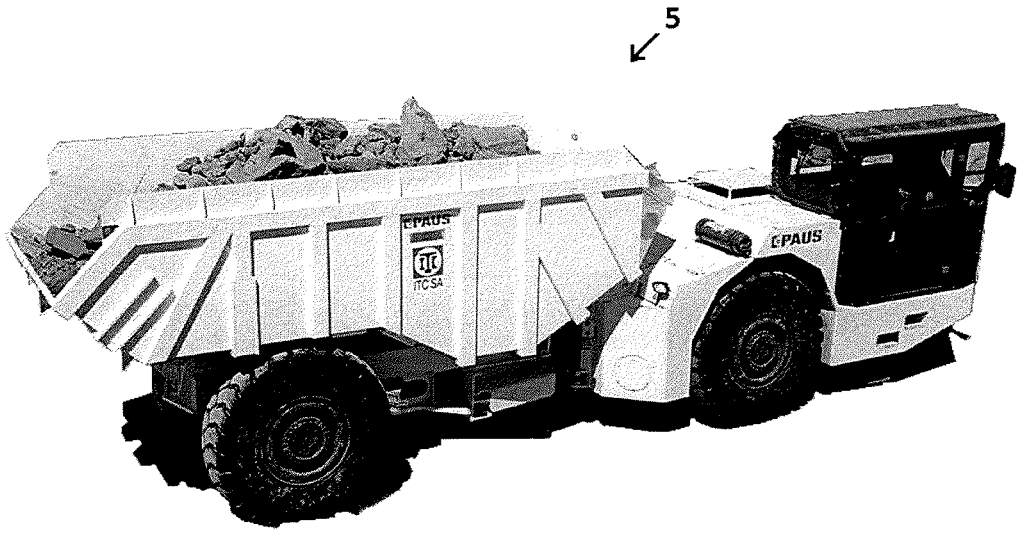
FIG. 4—Depicts a Haulage equipment employed by the ore production line of the conventional operation.

After the Continuous Loader, the rocks are transported to a haulage equipment (#5 in FIG. 4).

When the scoops are employed (on the first meters excavated in the rock body, for instance) the very same equipment is used for the hauling step. Similarly, when the ITC Schaeff Loader (or a similar equipment is used) a truck is employed at the hauling phase.

An alternative suggestion is for PAUS Trucks (see FIG. 4) to be used as preferred equipment employed at this step. This particular truck model can be loaded by the ITC loader at the face and dump the collected material at the ore sizer, the next step of the ore production line. The truck considered is the model 8000 with an ejection box that can easily fit in a 3 m wide opening and have an acceptable turning radius. The ITC 8000 TRUCK has a payload of 13 tonnes and a speed (loaded on 15% up ramp) of 6.0 kilometers per hour.

Preferably, in order to achieve optimum operational results, three trucks are simultaneously used.

Ore Sizer

The aforementioned "haulage equipment" transports the ore to the ore sizer.

The ore sizer consists of a hybrid portable ore crushing device equipped with a scalping screen to divert grossly oversize material from the muck flow, and either rollers or opposing jaws to reduce the run of mine ore to a maximum lump size of approximately 45 cm.

Storage Buffer

The storage buffer unit is made up of a series of flexible modular "shuttle" conveyors that feed material onto each other and can be easily extended and rearranged to accommodate different geometries and paths required to reach the RAIL-VEYOR loading point. The combined storage capacity of the shuttle car system must equal the volume or capacity of a fully loaded RAIL-VEYOR train (approximately 50-60 tons). This storage capacity accommodates potential operating efficiency differences or variations by providing a pre-measured full load for the RAIL-VEYOR, which lends itself better to automation and optimization.

Advantages:

All the methods and equipment described above, when working altogether, significantly increase the speed of access to the ore body in a rock mass as compared to conventional methods under the appropriate circumstances. From the initial 35 m/week depicted by the previous technologies, the present invention was able to improve the access rate in a hard rock mine to an overwhelming rate of 143 m/week in these minimal available headings.

Additionally, the present invention provides a safer environment for the mining personnel. This safer environment stems from the higher flow of fresh air directed to the work face provided by the twin ramps design; from a process that limits the use of scoops (LHD units) and human error derived from the use of this equipment; and from the creation of a new process that can easily be turned into an automated/remote controlled operation.

Although the present invention has been described in details with regards to the exemplary embodiments thereof and accompanying drawings, it should be apparent to those skilled in the art that various modifications of the present invention may be accomplished without departing from the spirit and the scope of the invention. Accordingly, the invention is not limited to the precise embodiments shown in the drawings and described above. Rather, it is intended that all such variations not departing from the spirit of the invention be considered as within the scope thereof as limited solely by the claims appended hereto.

The invention claimed is:

1. An ore production line for a hard rock mine comprising a work face of the mine and an outdoor environment, wherein the ore production line comprises the following separate equipment, linearly and sequentially arranged between the work face of the mine and the outdoor environment:

at least one continuous loader machine; followed by at least one haulage equipment; followed by an ore sizer equipment; followed by a storage buffer; followed by a particulate transportation machine comprising a pair of rails, and a set of cars interconnected by clevis joints, wherein each of the cars comprises a bottom and a flap that communicates with an adjacent car, and provides a continuous surface at the bottom of the cars, and wherein the particulate transportation machine does not comprise an internal drive but is configured to move using external drive stations that comprise rubber tires associated with electric motors.

2. The ore production line, according to claim 1, comprising two continuous loader machines.

3. The ore production line, according to claim 1, wherein the at least one haulage equipment comprises three trucks.

4. The ore production line, according to claim 1, wherein the ore sizer equipment is configured to limit particle size of collected material to a maximum lump size of 45 cm.

5. The ore production line, according to claim 1, wherein the storage buffer is capable of holding the volume of 50-60 tons.

6. A hard rock mining access operation comprising an ore production line for a hard rock mine; a hard rock mining access plan; and a ground support installation, wherein the ore production line comprises a work face of the hard rock mine and an outdoor environment, wherein the ore production line comprises the following separate equipment, linearly and sequentially arranged between the work face of the mine and the outdoor environment:

at least one continuous loader machine; followed by at least one haulage equipment; followed by an ore sizer equipment; followed by a storage buffer; followed by a particulate transportation machine comprising a pair of rails, and a set of cars interconnected by clevis joints, wherein each of the cars comprises a flap that communicates with an adjacent car and provides a continuous surface at the bottom of the cars, and wherein the particulate transportation machine does not comprise an internal drive but is configured to move using external drive stations that comprise rubber tires associated with electric motors;

wherein the hard rock mining access plan comprises two parallel ramps interconnected by a series of cross-cuts passageways, both ramps and the cross-cuts passageways being 2.9 to 3.3 meters high and 3.5 to 3.9 meters wide, wherein one of the ramps is exclusively set to accommodate the particulate transportation machine and the other ramp is set to be used by all other wheeled equipment that may come inside of the mine.

* * * * *